United States Patent [19]

Jones

[11] Patent Number: 5,042,654

[45] **Date of Patent: * Aug. 27, 1991**

[54] GOLF BAG HAVING HAND GRIPS IN ITS BASE

[75] Inventor: George H. Jones, Lake Oswego, Oreg.

[73] Assignee: Jones Sports Co., Portland, Oreg.

[ * ] Notice: The portion of the term of this patent subsequent to May 1, 2007 has been disclaimed.

[21] Appl. No.: 547,928

[22] Filed: Jul. 2, 1990

[51] Int. Cl.[5] ..... A63B 55/00; A63B 55/06

[52] U.S. Cl. ..... 206/315.3; 206/315.7; 248/96

[58] Field of Search ..... 206/315.2–315.7; 248/96; 280/DIG. 6; D3/37; D21/223

[56] References Cited

U.S. PATENT DOCUMENTS

| | | | |
|---|---|---|---|
| D. 244,705 | 6/1977 | Beste | D3/37 |
| 1,229,326 | 6/1917 | Schank | 206/315.7 |
| 3,371,898 | 3/1968 | Murray, Jr. | 248/96 |
| 3,799,227 | 3/1974 | Cantwell | 206/315.3 X |
| 4,012,051 | 3/1977 | Embinder | 206/315.4 X |
| 4,136,724 | 1/1979 | Leitzel | 206/315.6 |
| 4,143,694 | 3/1979 | Gregory | 206/315.2 X |
| 4,522,299 | 6/1985 | Clark et al. | 206/315.7 X |
| 4,620,682 | 11/1986 | Yim | 248/96 |
| 4,767,001 | 8/1988 | Kim | 206/315.4 X |
| 4,912,192 | 5/1990 | Jones | 248/96 |

*Primary Examiner*—Sue A. Weaver

*Attorney, Agent, or Firm*—Chernoff, Vilhauer, McClung & Stenzel

[57] ABSTRACT

A golf bag has a rigid cap at its lower extremity that has a cavity formed in it to provide a hand hold to facilitate lifting of the lower end of the bag when it is desired to move the bag in an horizontal orientation.

4 Claims, 3 Drawing Sheets

GOLF BAG HAVING HAND GRIPS IN ITS BASE

BACKGROUND AND SUMMARY OF THE INVENTION

This invention relates to golf bags, and in particular to devices for lifting golf bags.

While the normal handle or strap on the side of a golf bag works well for carrying the bag during a round of golf and for transporting the bag at most other times, neither of these elements work well when it is necessary to lift and move the bag in a horizontal or nearly horizontal orientation. This is because the strap and handle are offset toward the upper end of the bag to allow the bag to automatically drop to an upright position when it is lifted by the handle or strap, since a golf bag is normally carried in an upright position to prevent the clubs from falling out.

However, there are situations, such as when the bag is placed into or removed from the trunk of a car, when it is desirable to lift a golf bag while it is in a horizontal orientation. In order to facilitate horizontal lifting, prior art golf bags have utilized external straps or handles at their lower ends. While straps and handles do permit lifting and moving of the bag in a horizontal orientation, it is very easy to catch them on projecting objects when the bag is carried in its normal orientation, they get in the way when the bag is placed in a golf cart, and they detract from the appearance of the bag.

The subject invention overcomes the shortcomings and limitations of the prior art golf bags by utilizing a rigid cap at the bottom of the bag and placing a cavity in the cap that is configured to receive the user's hand. One wall of the cavity is oriented substantially parallel with the elongate axis of the bag and thus acts as a hand hold for lifting the base end of the bag. The hand hold has a plurality of slots formed in it that receive the user's fingers and permit obtaining a better grip.

In a preferred embodiment of the invention, the golf bag is of the type disclosed in Jones, U.S. Pat. No. 4,921,192 and has an integral support stand. In this bag a portion of the bottom surface of the bag is relieved to permit actuation of the stand without the stand actuation mechanism preventing the bag from resting on the ground on its bottom in an upright position. In this embodiment the cavity for the hand hold is placed in the relieved portion of the bottom.

Accordingly, it is a principal object of the present invention to provide a golf bag having a hand grip located integrally in its base to facilitate manipulation of the bag.

The foregoing and other objectives, features and advantages of the present invention will be more readily understood upon consideration of the following detailed description of the invention taken in conjunction with the accompanying drawings.

PREFERRED EMBODIMENT OF THE INVENTION

Figures 1, 2, 3:
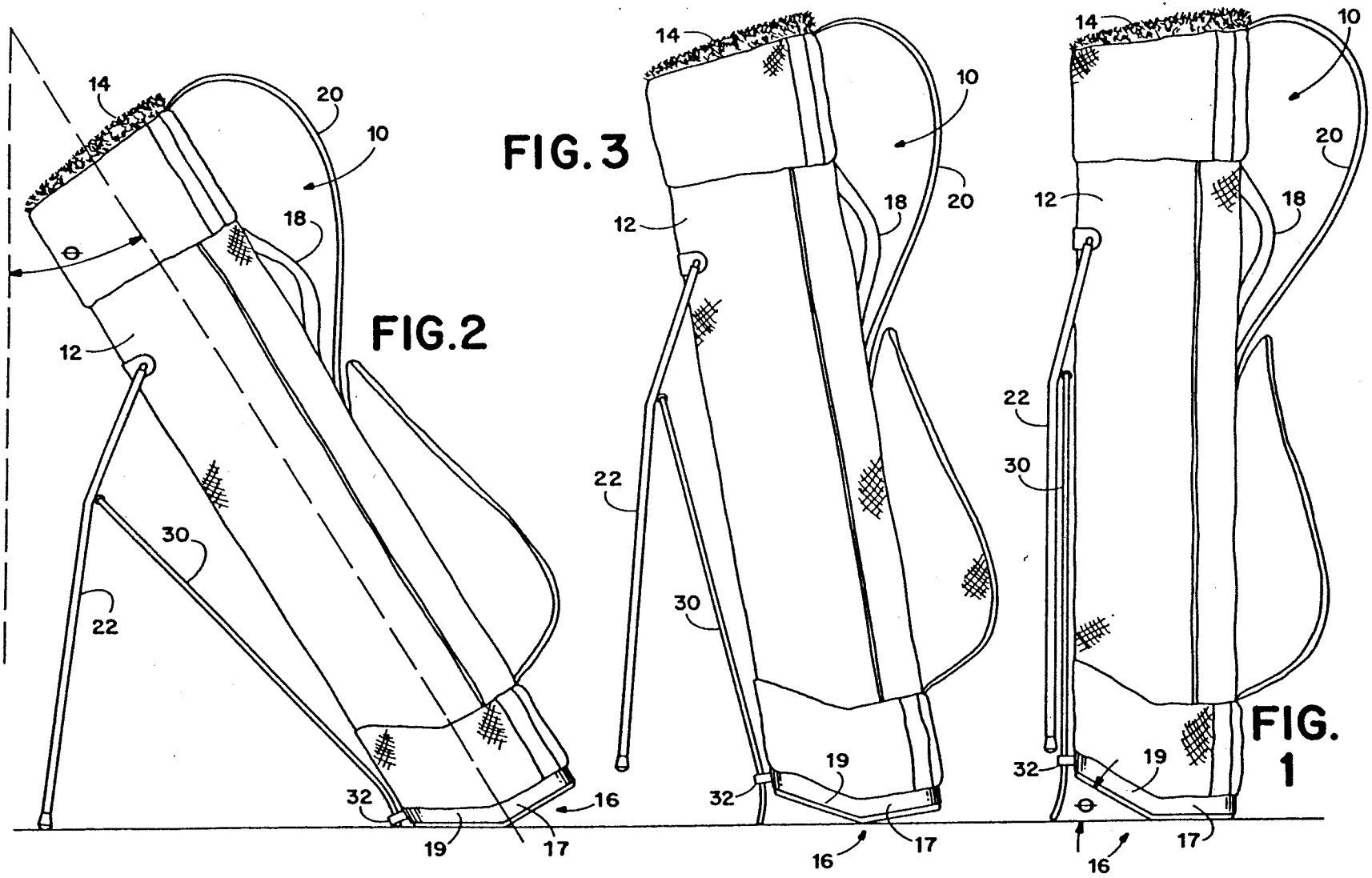
FIG. 1 is a side elevation view of a golf bag embodying the features of the present invention, shown with the legs retracted.
FIG. 2 is a side elevation view, of the golf bag of FIG. 1 shown with the legs fully extended.
FIG. 3 is a side elevation view of the golf bag of FIG. 1, shown with the legs partially extended.
Figure 4:
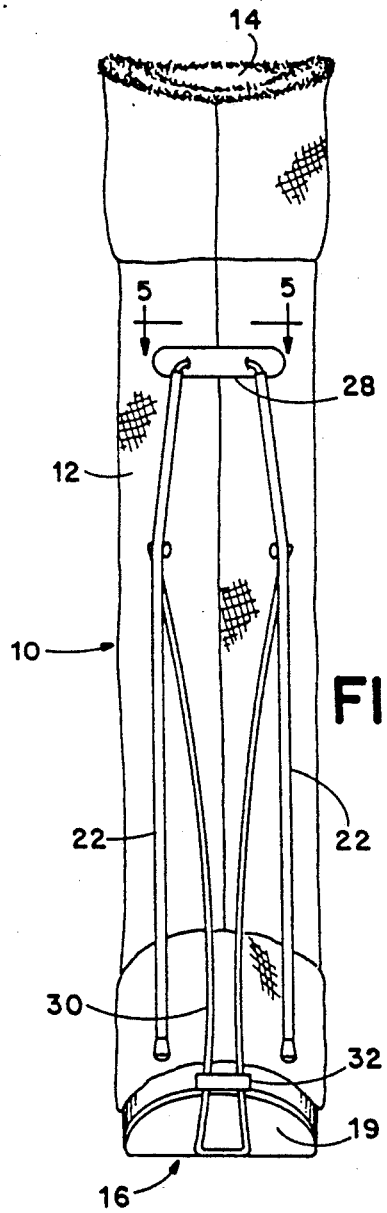
FIG. 4 is a rear view of the golf bag of FIG. 1.

Referring to the drawings, the golf bag 10 of the present invention comprises an elongate cylindrical shell 12 which is open at its upper end 14 to receive golf clubs 39 and is enclosed at its lower end by a rigid plastic cap 16. The shell can either be a unitary rigid sleeve or a rigid frame having a soft cover. Both types of construction are common and are well known in the golf bag industry. As is typical, the bag illustrated in the drawings has a handle 18 which allows the user to move or carry it with one hand, and a strap 20 which allows it to be carried over the user's shoulder. The bottom surface of the cap 16 includes a first portion 17 which is perpendicular with the center line of the shell 12 and a second portion 19 which is angled outwardly from the first portion at a predetermined angle $\theta$.

Figure 5:
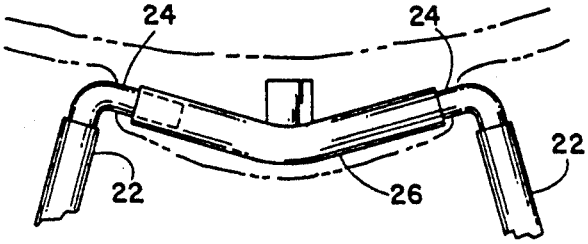
FIG. 5 is a fragmentary sectional view, partially broken away and at an enlarged scale, taken along the line of 5—5 of FIG. 4.

Pivotally attached to the side of the shell 12, opposite the side which contains the handle 18 and strap 20, are a pair of legs 22. Referring to FIG. 5, in the embodiment illustrated in the drawings the pivot is formed by the extremities 24 of the legs being bent at 90 degrees with respect to the rest of the legs, and these extremities being rotatably journaled in the ends of a bent tube 26 that is affixed to the shell 12. A fabric patch 28 covers the tube 26 for sake of appearance. The pivot allows the legs 22 to be rotated between a retracted position, where they rest against the side of the shell, FIG. 1, and an extended position, where they are angled outwardly from the side of the shell, FIG. 2. Because the tube 26 is bent, the legs also move away from one another as they move to their extended position thereby providing more stability. The length of the legs and the location of the pivot of the shell is arranged such that the legs do not extend beyond the bottom of the bag when they are in their retracted position. When the legs are in their extended position they act in conjunction with the second portion 19 of the bottom surface of the cap to support the bag with its center line being offset from the vertical by the same angle $\theta$ that the first and second of the bottom surfaces of the cap portions are separated from one another. The amount of the angle $\theta$ is such that the bag is sufficiently upright that clubs can easily be removed and inserted, and yet is steep enough that the bag is stable.

The legs are moved to their extended position by means of a U-shaped rod 30. The upper extremities of the rod 30 are pivotally attached to the legs 22 intermediate their ends. The lower closed end of the rod 30 fits slidably through a U-shaped bracket 32 which is attached to the shell immediately above the highest part of the second portion 19 of the bottom surface of the cap. When the rod 30 is pushed upwardly the legs 22 are moved to their extended position, and when the rod is pulled downwardly the legs are moved to the retracted position. When it is in the raised position the rod is angled with respect to the bag, which due to its interaction with the bracket 32, causes it to become bent. This bending creates a spring action which causes the rod to return to its lowered position unless it is kept in its raised position by the weight of the bag. Thus, when the bag is lifted off of the ground the legs automatically return to their retracted position. The rod 30 is sized such that when the legs are in their retracted position its lower end is approximately coplanar with the first portion 17 of the bottom surface of the cap, and when the legs are in their extended position its lower end is just above the highest portion of the second portion 19 of the bottom surface of the cap.

Thus the bag can be supported on the first portion 17 of the bottom surface of the cap, with the shell 12 in a vertical orientation, FIG. 1. This position would be used, for example, when the bag was momentarily set down when it was being transported, such as in the pro shop, or when the bag was placed in the bag rack of a golf car. By having the second portion 19 of the bottom surface of the cap angled with respect to the first portion, the rod does not have to extend below the first portion, thereby permitting the bag to be placed in an upright position on the first portion. However, the angled second portion allows the actuation rod to be exposed when the bag is tilted and thus permits the actuation rod to be moved to extend the legs.

Referring now to FIGS. 6–9, a hand grip for carrying the golf bag is incorporated into the cap 16. The center of the second portion 19 of the bottom surface is indented to form a cavity 34 into which one of the user's hands 36 can be inserted, FIG. 6. The top of the cavity 34 provides a platform 38 that supports the golf clubs 39. The platform 38 is oriented substantially normal to the elongate axis of the shell 12. Thus, golf clubs 39 placed in the golf bag above the second portion of the bottom surface of the cap will be supported on the perpendicular platform rather than on the angled second portion. In order to prevent the clubs from dropping from the platform 38 onto the first portion 17 of the bottom surface of the cap when the bag is moved, a divider 40 extends longitudinally along the bag between the two sections.

In order to facilitate using the hand grip, the wall 42 on the side of the cavity 34 that is adjacent to the first portion 17 of the bottom surface of the cap is oriented substantially parallel with the elongate axis of the shell 12 in order to create a hand hold. In addition, the wall 42 contains a plurality of slots 44 that receive the user's fingers.

Figure 6:
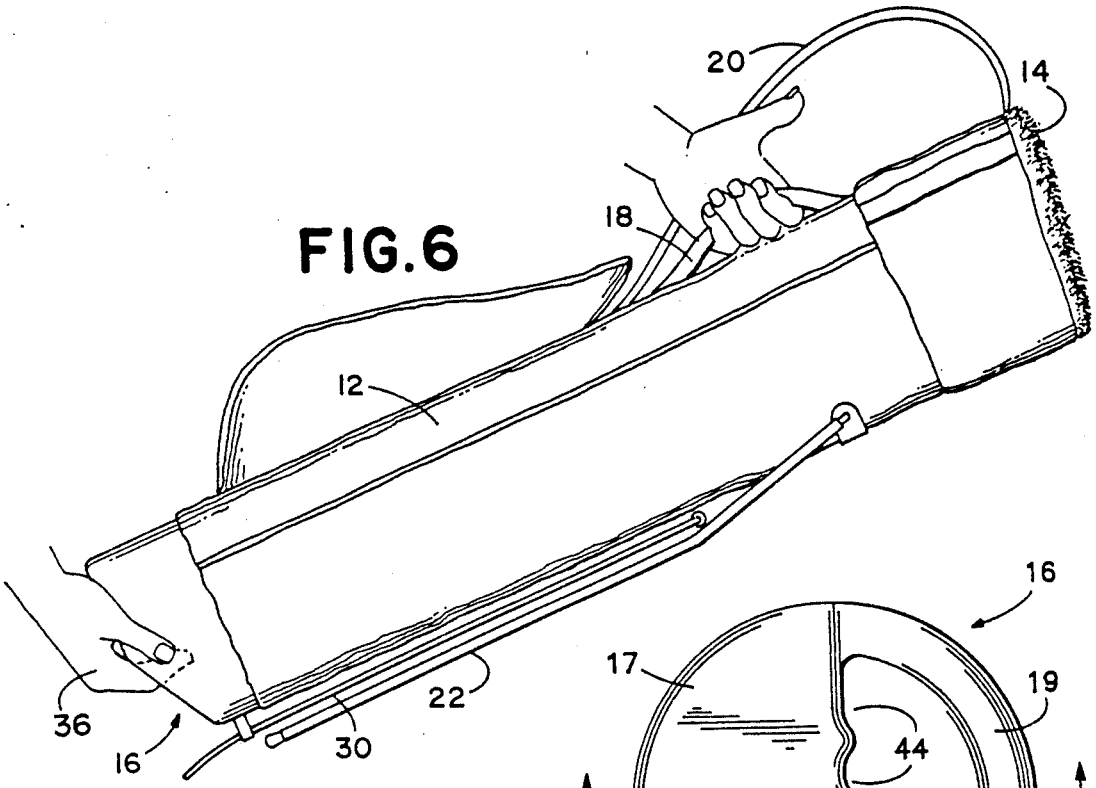
FIG. 6 is a side elevation view of the golf bag of FIG. 1 being carried by a user.
Figure 7:
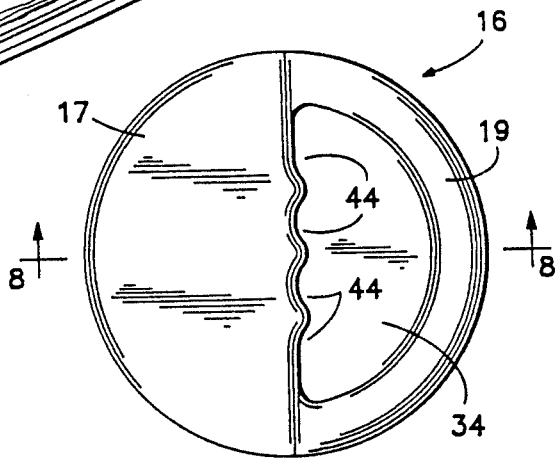
FIG. 7 is a bottom view of the golf bag of FIG. 1.
Figure 8:
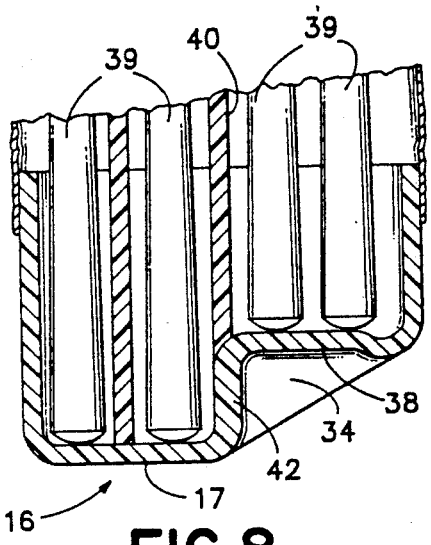
FIG. 8 is a fragmentary sectional view taken along the line 8—8 of FIG. 7.
Figure 9:
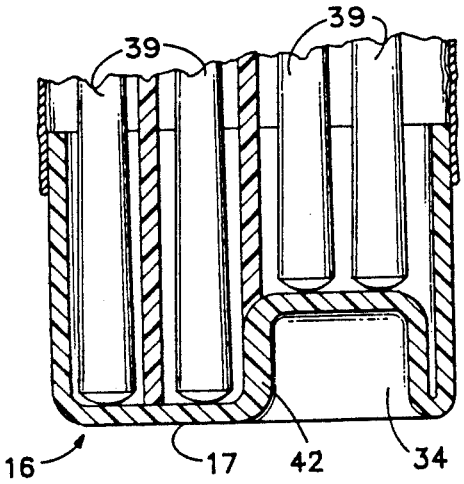
FIG. 9 is a fragmentary sectional view, similar to FIG. 8, of another embodiment of the invention.

As can be seen in FIG. 6, the hand grip allows the user to hold the bag both at the top, through the handle 18, and at the bottom, through the hand grip, in order to more easily maneuver the bag in those situations where the bag must be placed in a near horizontal orientation, such as when it is placed into or removed from the trunk of an automobile.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a golf bag having legs that are movable between an extended position where they support the bag upright and a retracted position where they are in adjacency with the bag, an actuation mechanism that moves the legs to their extended position when the bag is urged downwardly when in a vertical orientation with the actuation mechanism in contact with the ground, and a base that is partially relieved to permit downward movement of the bag when the actuation mechanism is in contact with the ground without the actuation mechanism being in contact with the ground when the bag is vertical and the non-relieved portion of the base is resting on the ground, the improvement comprising a platform positioned in the bag above the relieved portion of the base, said platform being planar and oriented substantially normal to the elongate axis of the bag and arranged to engage golf clubs placed in the bag above said relieved portion.

2. The golf bag of claim 1 wherein said relieved portion is partially depressed, thereby forming a cavity into which a user's hand can be inserted to carry the golf bag.

3. The golf bag of claim 2 including a hand hold on the side of said cavity that is adjacent to the remainder of said base, said hand hold being oriented substantially parallel with the elongate axis of the bag.

4. The golf bag of claim 3 wherein said hand hold has finger-receiving slots formed therein.

* * * * *